US007180493B2

(12) United States Patent
Shin et al.

(10) Patent No.: US 7,180,493 B2
(45) Date of Patent: Feb. 20, 2007

(54) LIGHT EMITTING DISPLAY DEVICE AND DRIVING METHOD THEREOF FOR REDUCING THE EFFECT OF SIGNAL DELAY

(75) Inventors: Dong-Yong Shin, Suwon-si (KR); Keum-Nam Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 197 days.

(21) Appl. No.: 10/957,136

(22) Filed: Sep. 30, 2004

(65) Prior Publication Data

US 2005/0140602 A1 Jun. 30, 2005

(30) Foreign Application Priority Data

Nov. 29, 2003 (KR) ..... 10-2003-0086106

(51) Int. Cl.
*G09G 3/36* (2006.01)

(52) U.S. Cl. ..... 345/92; 345/90; 345/84; 345/83; 345/77

(58) Field of Classification Search ..... None
See application file for complete search history.

(56) References Cited

U.S. PATENT DOCUMENTS 6,859,193 B1 * 2/2005 Yumoto ..... 345/82

* cited by examiner

*Primary Examiner*—Tuyet Thi Vo
(74) *Attorney, Agent, or Firm*—Christie, Parker & Hale, LLP

(57) ABSTRACT

Disclosed is a light emitting display device which provides a light emitting element for controlling the brightness according to the current to each pixel, such as an organic electroluminescent element, and a driving method thereof. The light emitting display device comprises transistors for forming a current mirror, and a pixel structure having first and second scan lines. A time to deselect the second scan signal that is supplied to the second scan line for writing display information on the pixel is earlier than a time to deselect the first scan signal that is supplied to the first scan line for selecting the pixel. As a result, reduction of brightness according to delay of the scan signal is prevented.

18 Claims, 10 Drawing Sheets

LIGHT EMITTING DISPLAY DEVICE AND DRIVING METHOD THEREOF FOR REDUCING THE EFFECT OF SIGNAL DELAY

CROSS REFERENCE TO RELATED APPLICATION

This application claims priority to and the benefit of Korea Patent Application No. 10-2003-0086106 filed on Nov. 29, 2003 in the Korean Intellectual Property Office, the entire content of which is incorporated herein by reference.

BACKGROUND OF THE INVENTION (a) Field of the Invention

The present invention relates to a light emitting display device. More specifically, the present invention relates to a light emitting display device using organic electroluminescent (EL) display device and a driving method thereof.

(b) Description of the Related Art

In general, an active matrix type image display apparatus has a plurality of pixels in the matrix form and controls intensity of light for each pixel according to given brightness information so as to display an image. As for an image display apparatus using liquid crystals as an electro-optic material, the transmittance of each pixel is variable depending on the voltage recorded in the pixel. The active matrix type image display apparatus using an organic EL material as an electro-optic material has the same basic operation as the liquid crystal display devices. Unlike the liquid crystal display devices, however, the organic EL image display apparatus is a self-luminous type that has a light-emitting element such as an Organic Light-Emitting Diode (OLED) in each pixel and exhibits high visibility of images and high response speed without a need for backlights. The brightness of each light-emitting element is controlled by the amount of current. By way of example, the organic EL image display apparatus has a striking difference from the liquid crystal display devices in that the light-emitting element is of a current-driven or current-controlled type.

Methods for driving the organic emission cells are classified into a passive matrix method, and an active matrix method using thin film transistors (TFTs). In the passive matrix method, anodes and cathodes are arranged to cross (i.e., cross over or intersect with) each other, and lines are selected to drive the organic emission cells. On the other hand, in the active matrix method, TFTs are coupled to ITO pixel electrodes, and each organic emission cell is driven according to a voltage maintained by a capacitor coupled to a gate of a TFT. The active matrix method is categorized, depending on the form of a signal applied to the capacitor for establishing the voltage, as a voltage programming method or a current programming method.

The pixel circuit of the conventional voltage programming method has difficulties in obtaining a high gray scale because of deviation of the threshold voltage $V_{TH}$ and the carrier mobility, the deviation being caused by non-uniformity of a manufacturing process. For example, in order to represent 8-bit (i.e., 256) gray scale in the case of driving a TFT by a voltage in the range of 3V (volts), it is required to apply the voltage to the gate of the TFT with an interval of less than 12 mV (=3V/256), but if the deviation of the threshold voltage of the thin film transistor caused by the non-uniformity of the manufacturing process is 100 mV, for example, it is difficult to represent the high gray scale.

The pixel circuit of the current programming method achieves uniform display characteristics even though the driving transistor in each pixel has nonuniform voltage-current characteristics, provided that a current source for supplying the current to the pixel circuit is uniform throughout the whole panel.

The current programming method has a benefit of compensating for the deviation of the threshold voltage and the mobility of the transistor used within the pixels, but it takes a long time to drive a data line with a current of the same magnitude as that of the current that flows to the OLED and this places certain limits to realizing a light emitting display device which has a high gray scale and high resolution.

FIG. 1 shows a configuration of a pixel circuit in a light emitting display device, which uses a current mirror for solving the above-described problem.

As shown, the pixel is formed at a point where a scan line crosses a data line. A signal Scan for selecting a pixel is applied to the scan line according to a predetermined cycle, and brightness information for driving the pixel is applied as a current Idata to the data line.

The pixel includes an OLED 1, two transistors 2 and 3 for configuring a current mirror, a storage capacitor 4 for storing the brightness information converted into a voltage level from the current Idata, and switches 5 and 6 for respectively controlling supply of the current Idata to the transistor 2 and the storage capacitor 4. The pixel circuit of FIG. 1 is coupled to a power line 7 and a ground line 8.

In order to select a pixel, the signal Scan transmitted through the scan line turns on the two switches 5 and 6. In detail, when the switch 5 is turned on, the current Idata including the brightness information applied to the data line flows to the transistor 2, and when the switch 6 is turned on, a voltage corresponding to the current Idata is charged in the storage capacitor 4. When the scan line becomes a non-selection state, the switches 5 and 6 are turned off, and the voltage programmed in the storage capacitor 4 is maintained. As a result, the voltage maintained by the storage capacitor 4 is applied to a gate of the transistor 3, and a corresponding drain current is generated through the transistor 3, thereby driving the OLED 1.

However, in a light emitting display device of the conventional pixel using a current mirror, the brightness is reduced as the location of the pixel becomes farther away from the scan driver.

In further detail, resistance of the switches 5 and 6 is gradually increased and almost no current flows to thus become a turned-off state during a short period in which the pixel is selected and is deselected by the scan line, and the voltage stored in the storage capacitor 4 is maintained. However, since a signal delay is generated because of parasitic elements (e.g., capacitance) of the scan line, and the rising time of the scan signal increases as the pixel is located farther from the scan driver. Therefore, it takes a long time to turn off the switches 5 and 6 in pixels that are located far from the scan driver. In this instance, when the resistance of the switch 5 becomes greater, the voltage at the drain of the transistor 2, i.e., the gate voltage, is increased, and accordingly, a voltage difference between the gate voltage of the transistor 2 and the gate voltage of the transistor 3 is generated. When the rising time of the scan signal is increased in this state, the voltage charged in the capacitor 4 is discharged through the switch 6 and the gate voltage at the transistor is increased since the switch 6 has been insufficiently turned off. Therefore, the brightness is reduced at the pixel which is far from the scan driver. As a result, the brightness over the whole screen does not become uniform and display characteristics are degraded.

SUMMARY OF THE INVENTION

In an exemplary embodiment of the present invention, a light emitting display device having uniform brightness over the screen, and a driving method thereof, is provided.

In one aspect of the present invention, a light emitting display device includes a plurality of data lines, formed in one direction, for transmitting a plurality of data currents, a plurality of first scan lines, crossing the data lines, for transmitting first scan signals, and a plurality of second scan lines, crossing the data lines, for transmitting second scan signals. A plurality of pixels are formed at pixel areas located at intersections of the data lines and the first and second scan lines. Each said pixel forms a path of a corresponding said data current transmitted through a corresponding said data line when the pixel is selected by a corresponding said first scan line, and performs a display operation according to the corresponding said data current supplied through the path when the pixel is selected by a corresponding said second scan line. A first scan driver and a second scan driver respectively generate the first scan signals for selecting the pixels and the second scan signals for writing display information on the pixels, and respectively apply them to the first and second scan lines. A data driver generates the data currents each having a current level according to the display information, and applies the data currents to the data lines. A time to deselect a corresponding said second scan signal is earlier than a time to deselect a corresponding said first scan signal.

An interval between the time to deselect the corresponding said first scan signal and the time to deselect the corresponding said second scan signal is greater than a time duration for deselection of the corresponding said second scan signal at one of the pixels which is farthest from the second scan driver.

Each said pixel may include a first transistor for forming the path for transmitting the corresponding said data current supplied through the corresponding said data line, and a first switch, operable by the corresponding said first scan signal, for controlling current supply between the corresponding said data line and the first transistor. Each said pixel may also include a storage capacitor for converting the corresponding said data current flowing through the first transistor into a voltage, and a second switch, operable by the corresponding said second scan signal, for performing a switching operation between the first transistor and the storage capacitor. Further, each said pixel may include a second transistor for forming a current mirror together with the first transistor, and generating the current corresponding to a voltage level of a voltage charged in the storage capacitor, and a light emitting element for emitting light according to a magnitude of the current supplied by the second transistor to perform a display operation.

The first switch may couple a drain of the first transistor to the corresponding said data line, and the second switch may couple the drain of the first transistor to a gate of the second transistor.

The first switch may be turned off according to a level modification of the corresponding said first scan signal when the second switch is turned off according to a level modification of the corresponding said second scan signal. The first and second switches may be turned on according to corresponding said first and second scan signals of a first level, the current provided from the data line may be transmitted to the storage capacitor through the first transistor, and the voltage corresponding to the current may be charged in the storage capacitor during a first period. The light emitting element may emit light according to the voltage charged in the storage capacitor during a second period. The second switch may be turned off according to the corresponding said second scan signal of a second level, the first switch may be turned off according to the corresponding said first scan signal of the second level, and the current supply to the first transistor may then be cut off during a third period.

In another aspect of the present invention, a method for driving a light emitting display device on which a pixel circuit is formed at a pixel area located at an intersection of a data line and first and second scan lines, is provided. The light emitting display device includes a light emitting element, a storage capacitor, a first transistor, and a second transistor forming a current mirror together with the first transistor. A first scan signal is supplied to the first scan line, and a path is formed for transmitting a data current supplied through the data line. A second scan signal is supplied to the second scan line, and the data current supplied through the data line is charged to the storage capacitor through the first transistor as a voltage. The light emitting element is allowed to emit light in response to a current which is transmitted from a second transistor forming a current mirror together with the first transistor and which corresponds to the voltage charged in the storage capacitor. A time to deselect the second scan signal is earlier than a time to deselect the first scan signal.

In yet another aspect of the present invention, a light emitting display device includes a plurality of data lines for transmitting a plurality of data currents, a plurality of first scan lines for transmitting a plurality of first scan signals, a plurality of second scan lines for transmitting a plurality of second scan signals, and a plurality of pixels. Each said pixel is coupled to a corresponding said data line, a corresponding said first scan line, and a corresponding said second scan line. A corresponding said second scan signal for writing display information to one said pixel, which is transmitted on the corresponding said second scan line, is deselected prior to deselecting a corresponding said first scan signal, which is transmitted on the corresponding said second scan line, for selecting the one said pixel

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, simply by way of illustration. As those skilled in the art would realize, the present invention may be modified in various different ways, all without departing from the spirit or scope of the present invention. Accordingly, the drawings and description are to be regarded as illustrative in nature, and not restrictive.

To clarify the present invention, parts which are not described in the specification may have been omitted. Coupling a first element to a second element refers to both cases of: 1) directly coupling the first element to the second element; and 2) coupling the first element to the second element with a third element provided therebetween.

A light emitting display device and a driving method thereof according to an exemplary embodiment of the present invention will be described in detail with reference to the drawings. The light emitting display device to be described below includes an organic EL light emitting display device having organic light emitting cells. However, the light emitting display device is not limited to the organic EL light emitting display device, and may include any suitable light emitting display devices.

In the light emitting display device, transistors are used to configure a current mirror. Further, a first scan signal for selecting a pixel of one row and a second scan signal for writing display information on the selected pixel are supplied to the respective pixels through different scan lines. In addition, a time to deselect the second scan signal is established to be earlier than a time to deselect the first scan signal so that a reduction of brightness which is generated for pixels farther from the scan driver for supplying the first or second scan signal is prevented.

The light emitting display device having the above-described features will now be described.

Figure 1:
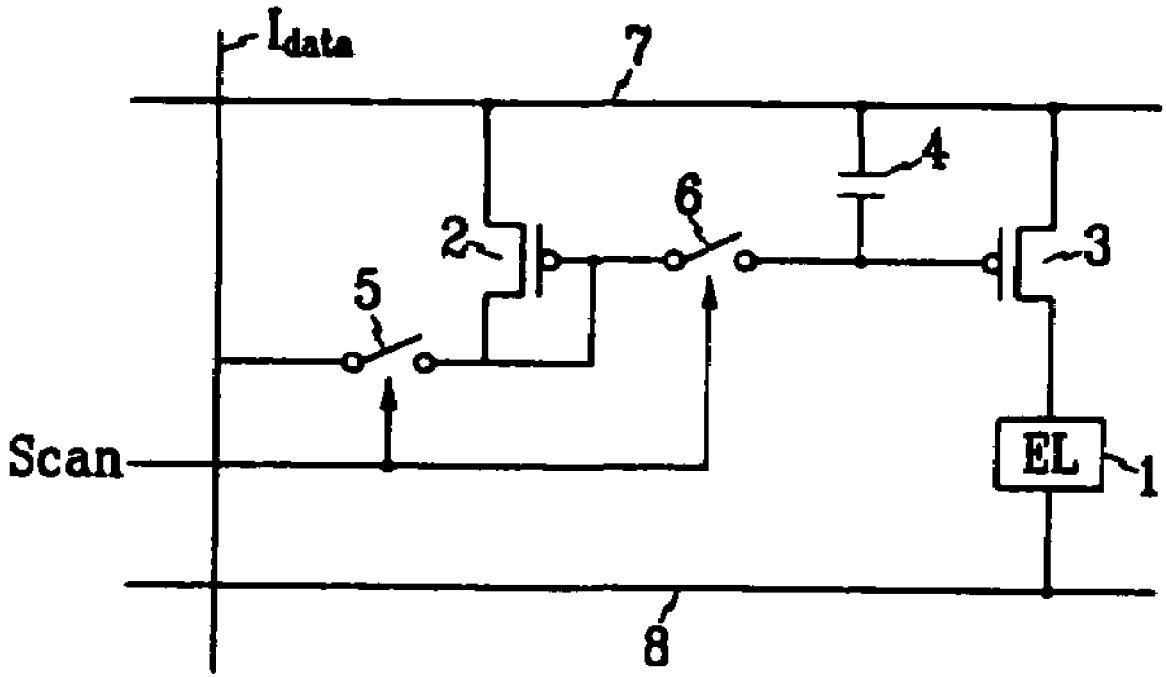
FIG. 1 (Prior Art)
FIG. 1 shows a conventional pixel circuit diagram.
Figure 2:
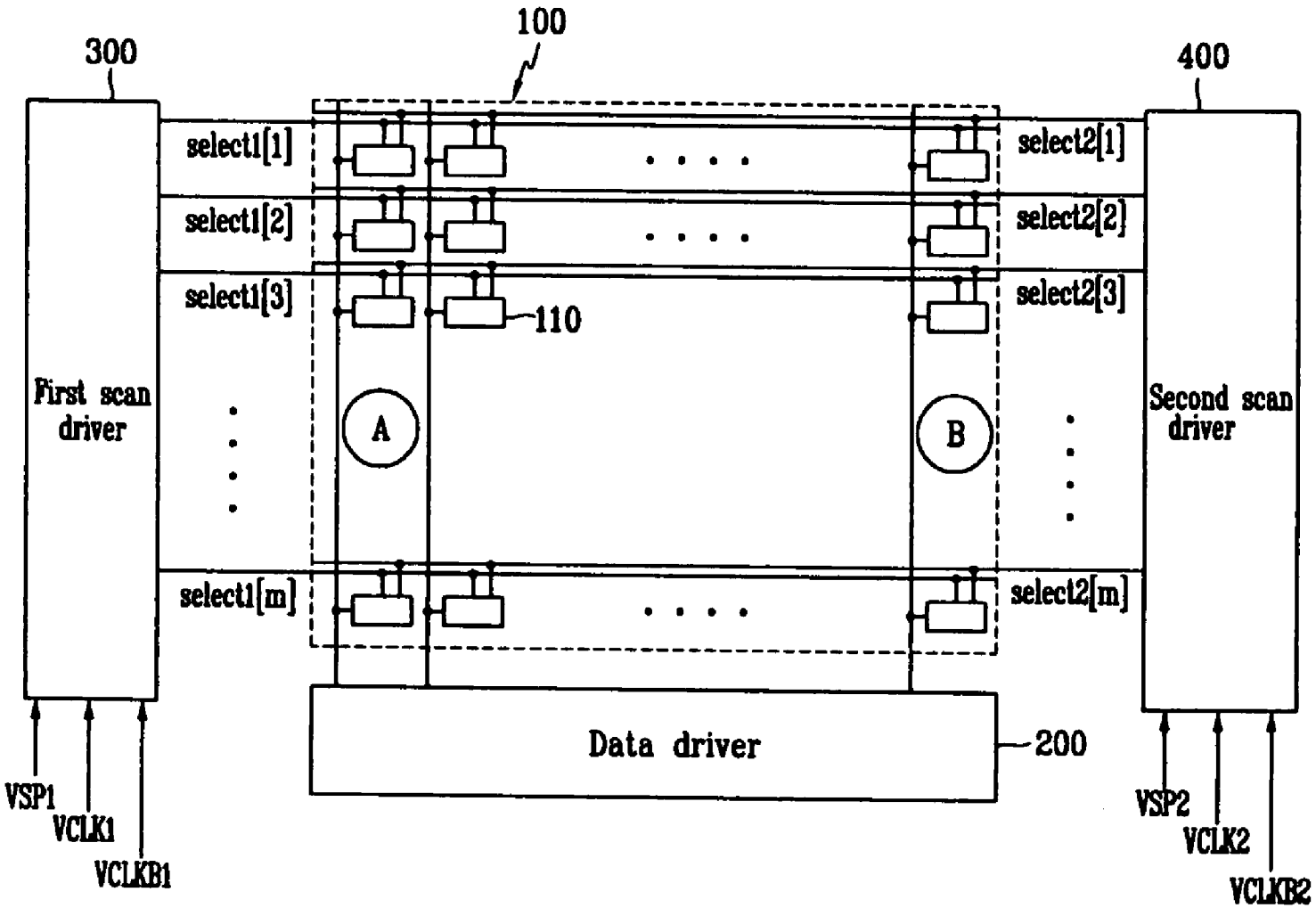
FIG. 2 shows a configuration of a light emitting display device according to an exemplary embodiment of the present invention.

As shown in FIG. 2, the light emitting display device includes an organic EL display panel (referred to as a display panel hereinafter) 100, a data driver 200, and first and second scan drivers 300 and 400.

The display panel 100 includes a plurality of data lines arranged in the row direction, and a plurality of scan lines arranged in the column direction. A plurality of pixel circuits 110 are arranged in a matrix format.

The scan lines include a plurality of first scan lines scan1[1] to scan1[m] for transmitting first scan signals scan1 for selecting pixels, and a plurality of second scan lines scan2[1] to scan2[m] for transmitting second scan signals scan2 for controlling an emitting period of an organic EL element. The first scan lines are for selecting pixels, and the second scan lines are for writing current signals (display information), transmitted through the data lines, on the corresponding pixels.

The pixel circuits 110 are formed at pixel areas defined by the data lines and the first and second scan lines. Each pixel forms a transfer path of the current applied through the data line when it is selected by the first scan line, and performs a display operation according to the current supplied through the data line when it is selected by the second line. In this instance, the display operation represents an operation for programming the data (data current $I_{DATA}$) supplied by the data line to the pixel, and allowing the pixel to emit light according to the programmed data.

The data driver 200 applies the data currents $I_{DATA}$ to the data lines.

The first scan driver 300 generates first scan signals scan1 for selecting pixels according to clock signals VCLK1 and VCLKB1 based on an input signal VSP1. Similarly, the second scan driver 400 generates second scan signals scan2 for writing display information (brightness information) to the corresponding pixels according to clock signals VCLK2 and VCLKB2 based on an input signal VSP2. The first scan signals scan1 and the second scan signals scan2 are then applied, respectively, to the first and second scan lines of the corresponding rows. In this instance, the time to deselect the second scan signal scan2 is established to be earlier than the time to deselect the first scan signal scan1 by controlling the clock signals VCLK1, VCLKB1, VCLK2, and VCLKB2 which are input to the respective scan drivers 300 and 400 and that control outputs of the scan signals. Also, pulse widths (driving times) of the first and second scan signals scan1 and scan2 can be established to be substantially the same as each other.

The first and second scan drivers 300 and 400 and/or the data driver 200 may be coupled to the display panel 100, may be provided in a chip format to a tape carrier package (TCP) attached and coupled to the display panel 100, may be provided in a chip format to flexible printed circuit (FPC) or a film attached and coupled to the display panel 100 which is referred to as a chip-on-film (COF) method, or may be directly provided on a glass substrate of the display panel which is referred to as a chip-on-glass (COG) method. They may also be substituted for a driving circuit formed on the same layer as those of the scan lines, data lines, and TFTs on the glass substrate.

The pixel circuit 110 of the light emitting display device according to an exemplary embodiment of the present invention will be described with reference to FIG. 3.

Figure 3:
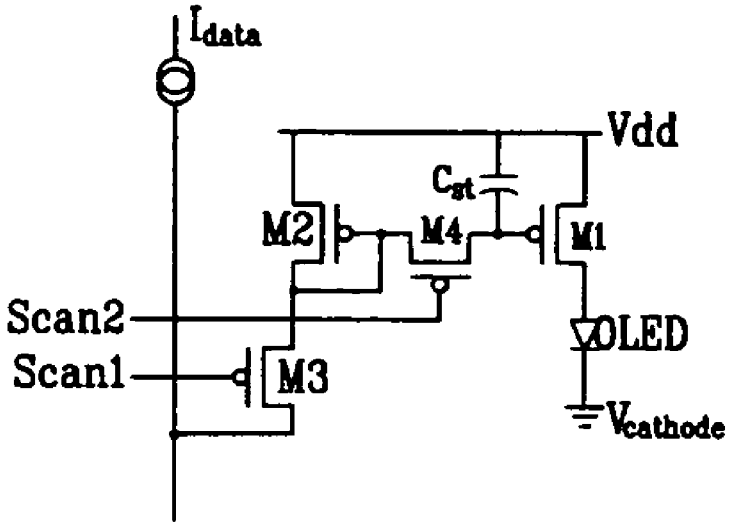
FIG. 3 shows a pixel configuration of a light emitting display device according to an exemplary embodiment of the present invention.

FIG. 3 shows an equivalent circuit diagram of the pixel circuit according to the exemplary embodiment of the present invention. For ease of description, the pixel circuit coupled to the $n^{th}$ data line and $m^{th}$ scan line is illustrated.

As shown, the pixel circuit 110 includes an organic EL element OLED, transistors M1, M2, M3, M4, and a storage capacitor Cst. The transistors M1 to M4 include PMOS transistors. It is desirable for the transistors to be TFTs each of which has a gate electrode, a drain electrode, and a source electrode formed on the glass substrate of the display panel 100 as a control electrode, and two main electrodes. In other embodiments, the transistors may be NMOS transistors, any other suitable transistors, or any combination thereof.

In further detail, a cathode voltage Vcathode is applied to a cathode electrode of the OLED, and a drain electrode of the transistor M1 is coupled to an anode electrode thereof. A power supply voltage Vdd is applied to a source electrode of the transistor M1, and the storage capacitor Cst is coupled between the gate electrode and the source electrode of the transistor M1. A gate electrode and a drain electrode of the transistor M2 are coupled to each other, and the power supply voltage Vdd is applied to a source electrode of the transistor M2. The two transistors M1 and M2 form a current mirror. The gate electrodes of the transistors M1 and M2 are coupled, respectively, to a source electrode and a drain electrode of the transistor M4, and a gate electrode of the transistor M4 is coupled to the second scan line. The drain electrode of the transistor M2 is coupled to a source electrode of the transistor M3. Also, a gate electrode of the transistor M3 is coupled to the first scan line, and a drain electrode thereof is coupled to the data line.

An operation of the light emitting display device according to the exemplary embodiment of the present invention will now be described with reference to FIG. 4.

Figure 4:
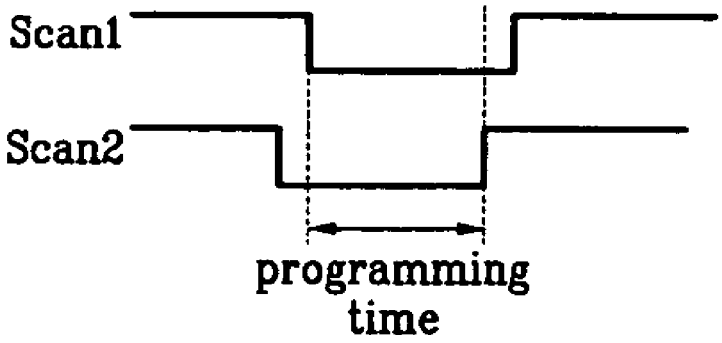
FIG. 4 shows a timing diagram of first and second scan signals according to an exemplary embodiment of the present invention.

FIG. 4 shows a timing diagram of first and second scan signals according to the exemplary embodiment of the present invention.

As shown, when the second scan signal scan2 is selected (e.g., when it is varied to a low level from a high level), the transistor M4 is turned on. When the first scan signal scan1 is selected while the transistor M4 is turned on, the transistor M3 is turned on and the transistors M2 (which is diode-connected) and M3 form a current path so that a current transmitted by the data line flows to the path through the transistors M2 and M3. Accordingly, a voltage is generated between the gate electrode and the source electrode of the transistor M2. The gate-source voltage of the transistor M2 is determined by the magnitude of the drain current of the transistor M2, and the gate-source voltage is charged in the storage capacitor Cst through the turned-on transistor M4.

The storage capacitor Cst applies the charged voltage to the gate electrode of the transistor M1. The transistor M1 generates a drain current corresponding to a gate voltage, and the OLED is driven by the drain current to thus emit light with desired brightness.

When the second scan signal scan2 is deselected (e.g., it is varied to the high level from the low level) while the OLED emits light, the transistor M4 is turned off, and hence, the voltage charged in the storage capacitor Cst is not influenced by the transistor M3, and the OLED continues to emit light. If the transistors M4 and M3 were concurrently turned off unlike in the exemplary embodiment, or the transistor M3 were turned off before the transistor M4 is turned off, the voltage charged in the storage capacitor Cst would be discharged through the transistor M4, and the amount of light emitted by the OLED would be reduced. However, since the transistor M4 is completely turned off before the transistor M3 is turned off according to the exemplary embodiment, the OLED sufficiently emits light according to the voltage sustained at the storage capacitor Cst.

After this, when the first scan signal scan1 is deselected, the transistor M3 is turned off to cut off the current supply from the data line, and the OLED continues to emit light using the drain current of the transistor M1 which flows corresponding to the voltage sustained by the storage capacitor Cst.

It is desirable in the light emitting display device to establish the time to deselect the second scan signal scan2 to be earlier than the time to deselect the first scan signal scan1, and establish a corresponding interval to be greater than the time for deselection of the second scan signal scan2 at the pixel which is located farthest from the second driver. The interval is a time in consideration of an amount of time delays caused by a parasitic component (e.g., capacitance) on the scan line. The time for deselection is a rising time in which the scan signal is varied to the high level from the low level, and in addition, the time for deselection can be a falling time in which the scan signal is varied to the low level from the high level when the transistor M4 of the pixel circuit is replaced by an NMOS transistor.

The pixel current of the pixel A which is located nearest the first scan driver from among the pixels of one row, and the pixel current of the pixel B which is located nearest the second scan driver from among the pixels of the same row when the light emitting display device is driven as described above, are illustrated in FIGS. 5A, 5B, 6A, and 6B, respectively.

Figure 5A:
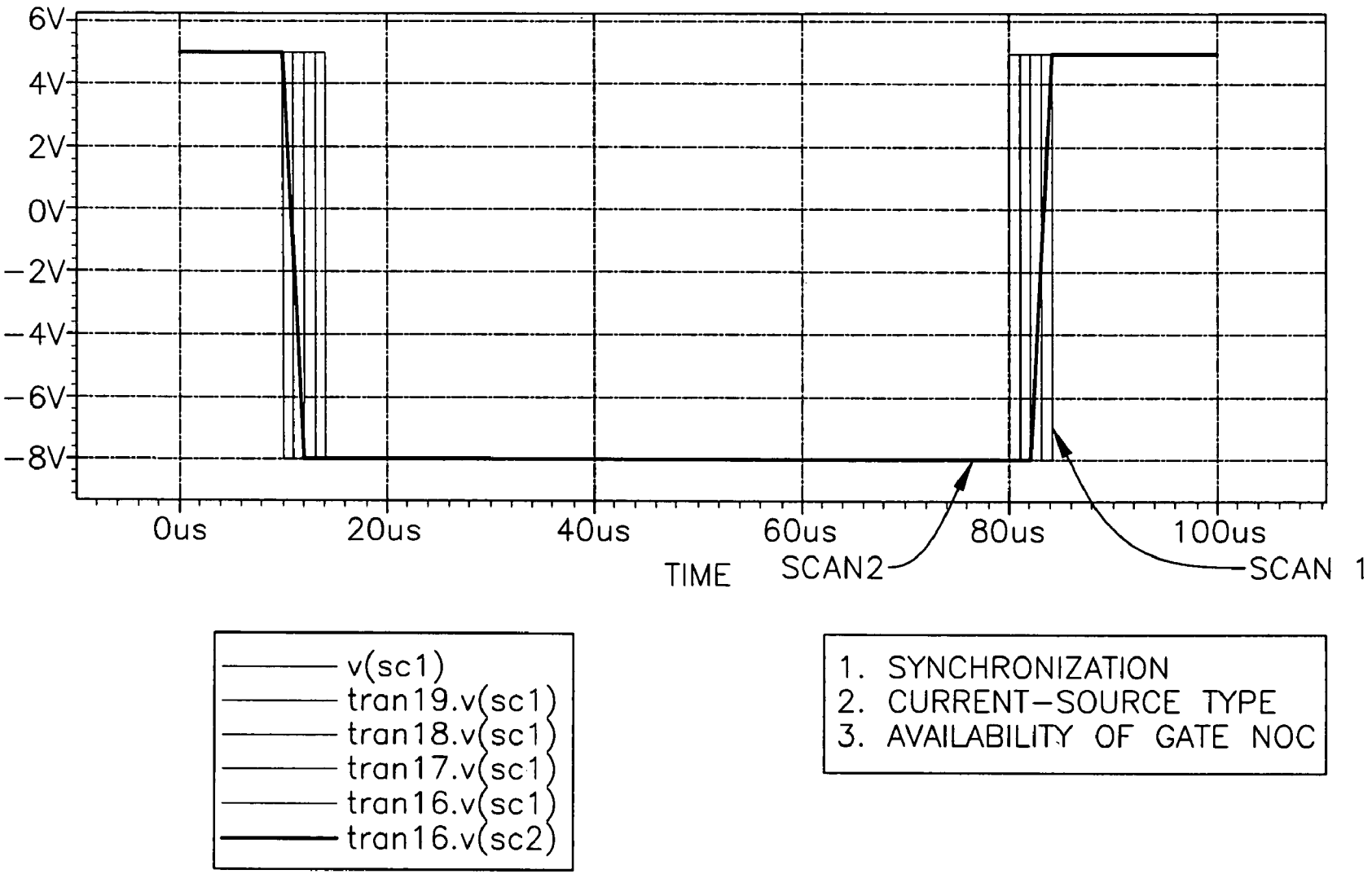
FIGS. 5A and 5B show graphs for illustrating scan signals and currents in the pixel A shown in FIG. 2.
Figure 5B:
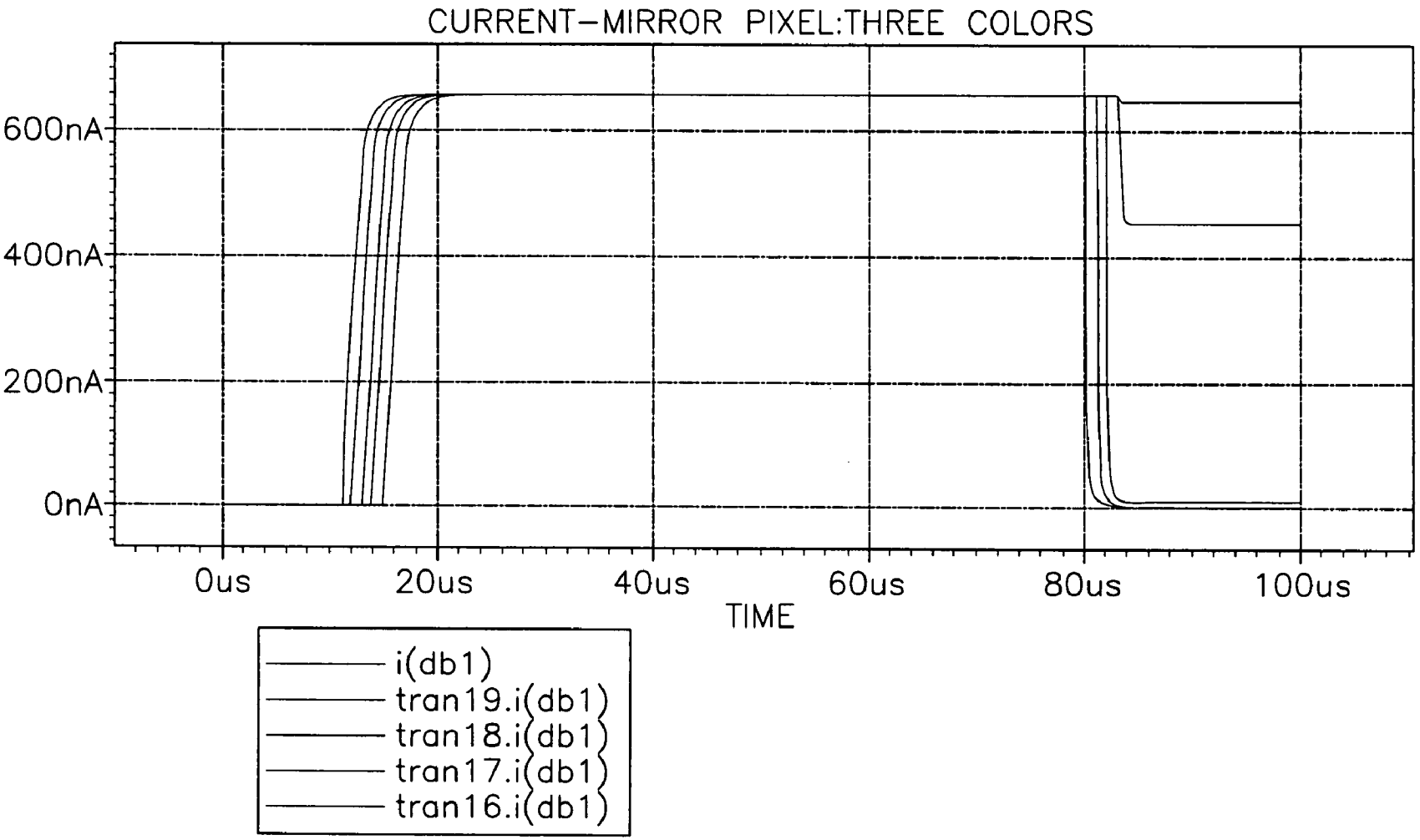

FIG. 5A shows a relational graph of the first and second scan signals at the pixel A which is nearest the first scan driver 300 in the light emitting display device shown in FIG. 2, and FIG. 5B shows a graph that shows the current (in particular, the current flowing through the transistor M1) of the pixel A according to the relationship. In particular, FIG. 5A shows a waveform diagram for illustrating the relationship between the first and second scan signals at the pixel A when the rising/falling time of the first scan signal scan1 is 0 μs and when the rising/falling time of the second scan signal scan2 is 2 μs.

It is known from FIGS. 5A and 5B that the current flowing to the pixel after the selection of the first and second scan signals scan1 and scan2 is deselected according to the relationship between the first and second scan signals scan1 and scan2.

In detail, referring to FIGS. 5A and 5B, the pixel current of the first scan signal which is leftmost from among the first scan signals scan1 is the lowest, and the pixel current is not reduced significantly as the first scan signal scan1 moves to the right, that is, as the selection of the first scan signal is deselected later than the second scan signal scan2.

Figure 6A:
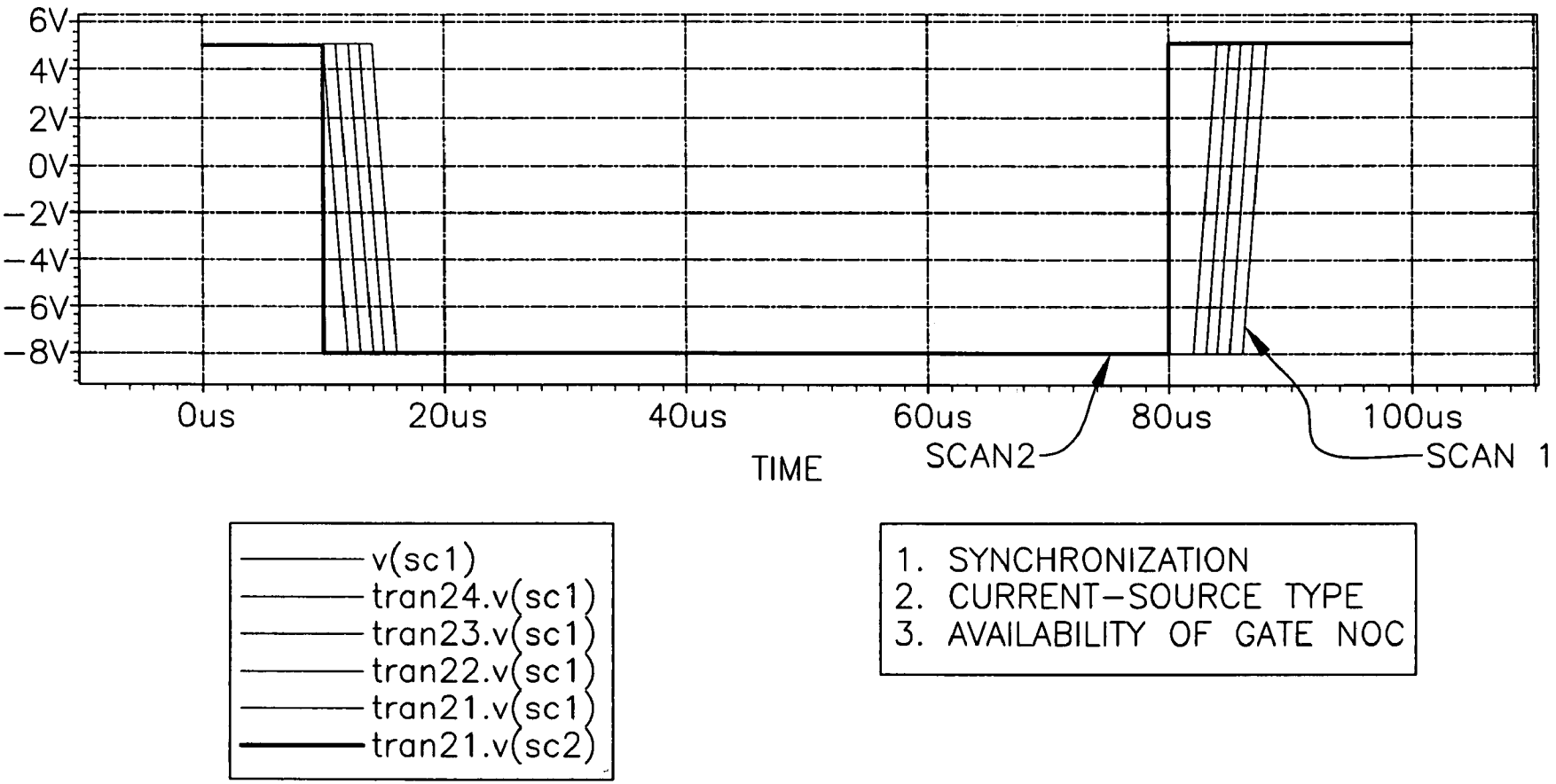
FIGS. 6A and 6B show graphs for illustrating scan signals and currents in the pixel B shown in FIG. 2.
Figure 6B:
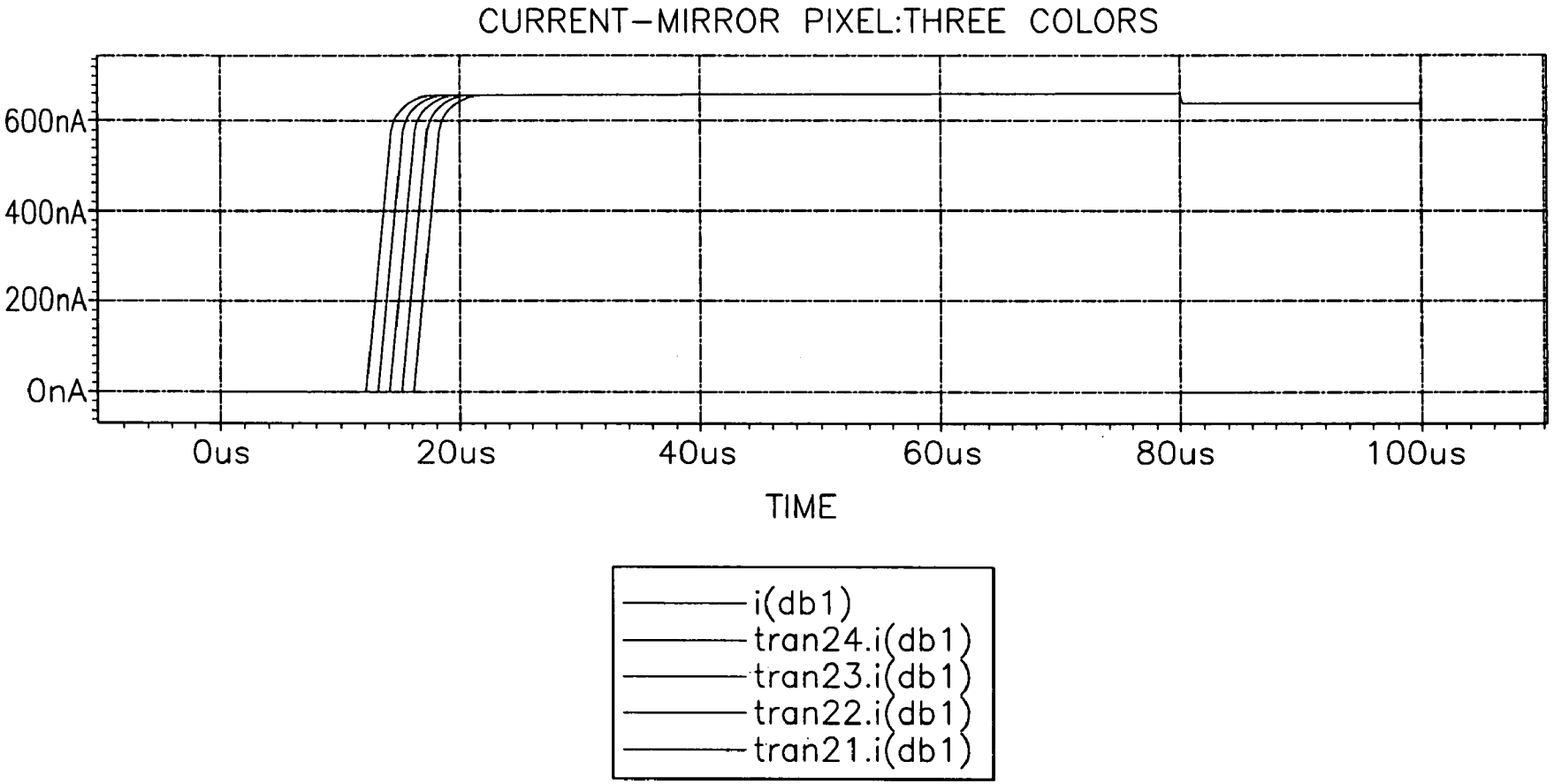

FIG. 6A shows a relational graph of the first and second scan signals at the pixel B in the light emitting display device shown in FIG. 2, and FIG. 6B shows a graph of the current of the pixel B according to the above relationship. FIG. 6A shows a waveform diagram of the relationship between the first and second scan signals at the pixel B when the rising/falling time of the first scan signal scan1 is 0 μs and when the rising/falling time of the second scan signal scan2 is 2 μs.

Since the rising/falling time of the second scan signal scan2 at the pixel B which is nearest the second scan driver 400, the selections of the second scan signals scan2 are deselected prior to the first scan signals scan1 as shown in FIG. 6A, and hence, the currents of the pixel B are the same as shown in FIG. 6B.

It is known from FIGS. 5A to 6B that the current of the pixel A becomes very much less than the current of the pixel B when the time of up to deselection of the first scan signal scan1 after deselection of the second scan signal scan2 is insufficient.

Figure 7:
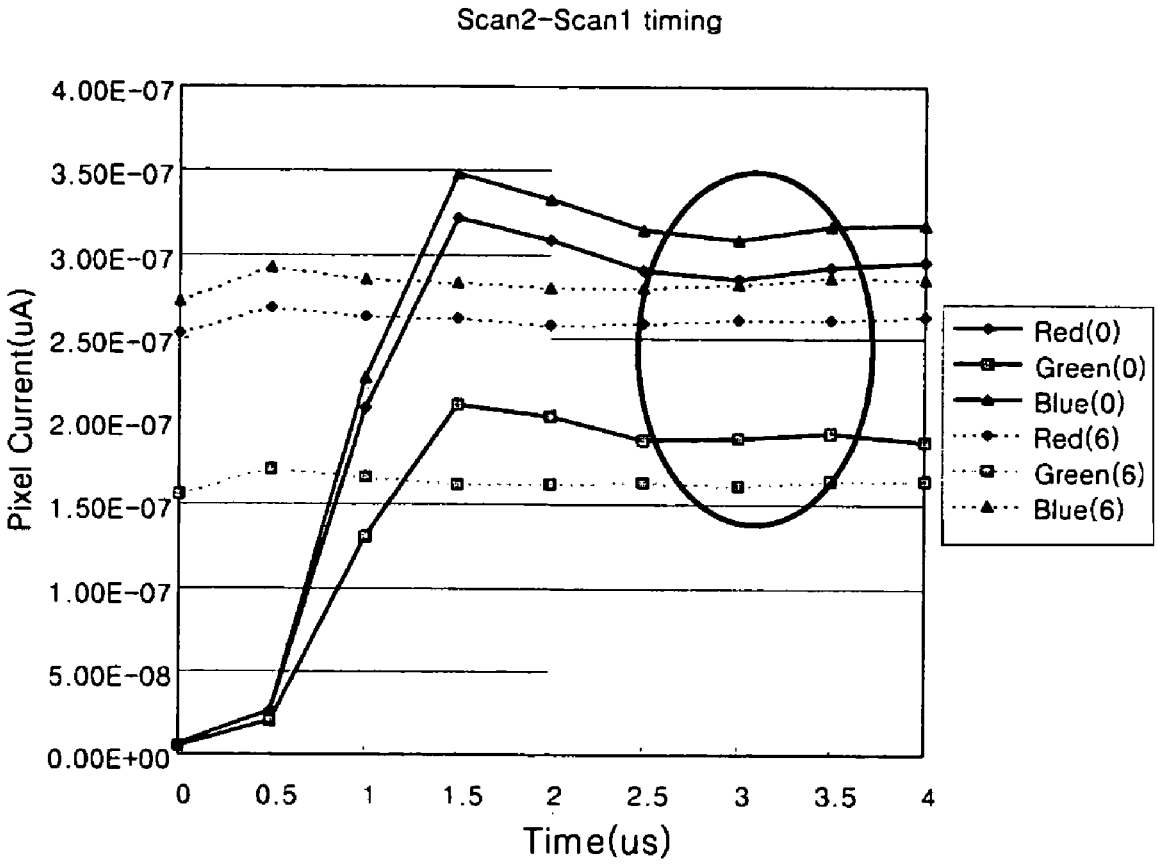
FIG. 7 shows a graph for indicating current variation between pixels according to intervals of deselection of the first and second scan signals according to an exemplary embodiment of the present invention.

FIG. 7 shows a detailed relationship of the currents between the pixels A and B having the above-noted features. Solid lines in FIG. 7 represent the currents of the pixels A which are nearest the first scan driver, and dotted lines depict the currents of the pixels B which are nearest the second scan driver. The X axis indicates intervals between the time to deselect the first scan signal and the time to deselect the second scan signal, and the Y axis indicates the currents of the corresponding pixels.

It is known from FIG. 7 that the current differences between the pixels A and B are given according to the intervals between the time to deselect the first scan signal and the time to deselect the second scan signal. That is, the current difference between the pixels A and B becomes very much greater when the interval is less than 1 μs as shown in FIG. 7, and the current difference between the pixels A and B is reduced when the interval is greater than 1 μs. In particular, the current difference between the pixels A and B starts to be reduced at 1 μs, the current difference is substantially reduced at 1.2 μs or 1.5 μs, almost no current difference between the pixels A and B is provided, and the current difference is maintained for up to 4 μs. That is, when the interval exceeds an appropriate time, almost no current difference is generated between the pixels respectively provided at both panels when the scan signal is delayed.

Based on this result, when the interval between the time to deselect the first scan signal scan1 and the time to deselect the second scan signal scan2 is provided within 1 to 4 μs, the transistor M3 is turned off after the transistor M4 of the pixel circuit 110 is turned off, and accordingly, the problem of reducing the brightness according to delay of the scan signals is effectively prevented. In particular, the reduction of brightness is effectively prevented when the interval is provided within the range of 1.2 to 4 μs or 1.5 to 4 μs.

As described above, reduction of brightness is prevented by establishing the time to deselect the second scan signal scan2 for writing display information on the pixels of one row to be earlier than the time to deselect the first scan signal scan1 for selecting the pixels and driving the light emitting display device.

Different times to deselect the first and second scan signals can be applied to the pixels which have structures different from that of the pixel shown in FIG. 3.

Figure 8:
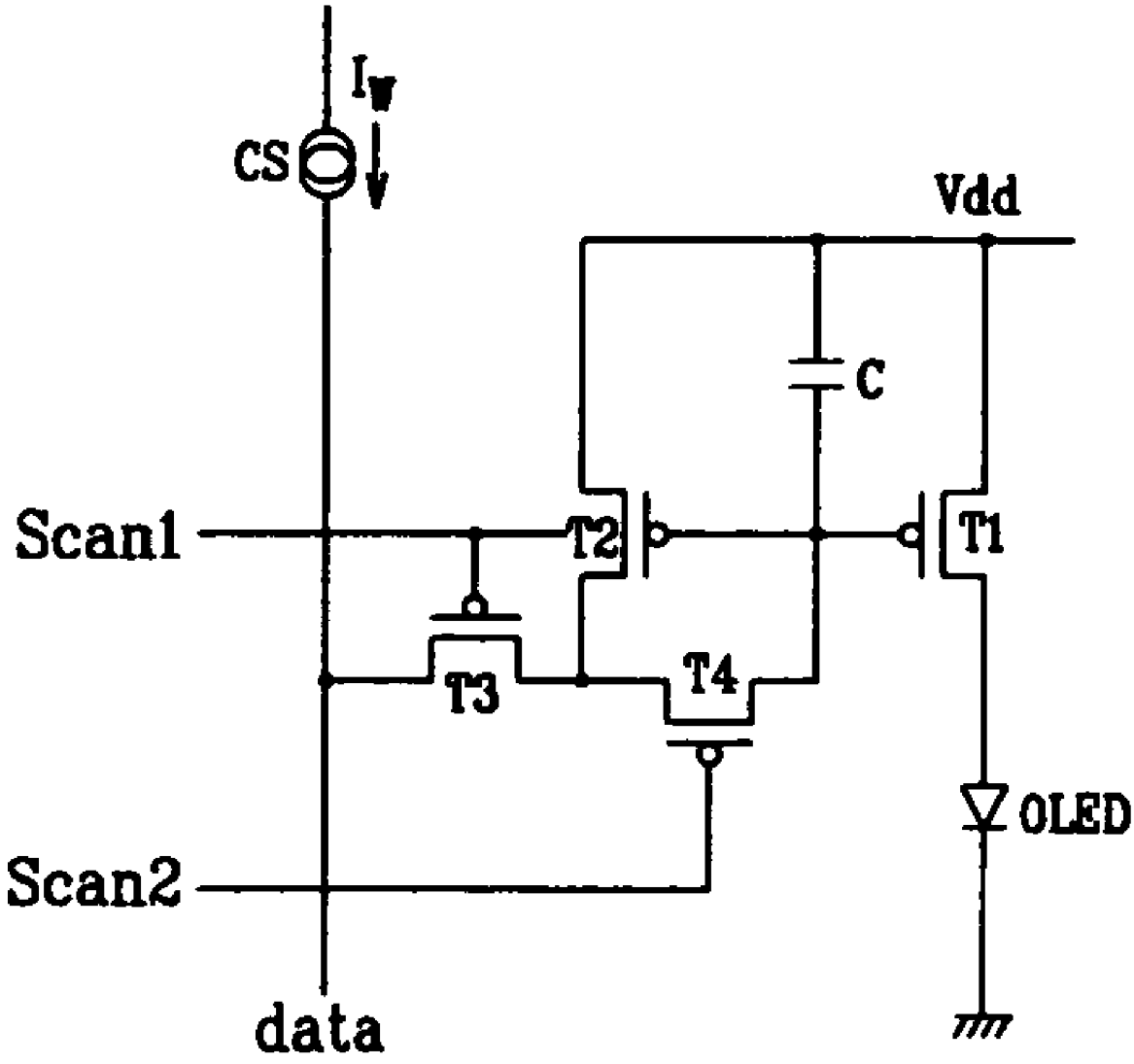
FIG. 8 shows a pixel circuit diagram according to another exemplary embodiment of the present invention.

FIG. 8 shows a circuit diagram of a pixel according to another exemplary embodiment of the present invention. The pixel circuit of FIG. 8, for example, may be applied to the light emitting display device of FIG. 2.

The pixel circuit shown in FIG. 8 includes transistors for forming a current mirror in the same manner as the pixel circuit of FIG. 3. In detail, the pixel circuit includes transistors T1 and T2 for forming a current mirror, an organic EL element OLED which is coupled to the transistor T1 and emits light according to the applied current, a capacitor C formed between the transistors T1 and T2, a transistor T3 operable by the first scan signal scan1 to transmit the data current provided from the data line, and a transistor T4 operable by the second scan signal scan2 to charge the voltage generated between the gate electrode and the source electrode of the transistor M1 in the capacitor C according to the current provided from the transistor T3.

When the transistors T3 and T4 are respectively turned on in response to the selection of the first and second scan signals scan1 and scan 2, the transistor T2 is diode-connected, the current provided from the data line flows to the path where the transistors T2 and T3 are provided, and hence, a voltage is generated between the gate electrode and the source electrode of the transistor T2. The voltage is charged in the capacitor C, and the organic EL element OLED emits light by the current flowing from the transistor T1 according to the voltage charged in the capacitor C.

When the selections of the first and second scan signals scan1 and scan 2 are concurrently deselected, the capacitor C is discharged through the transistor T4 by the drain voltage of the transistor T2 which is increased according to increases of resistance at the transistor T3, and the amount of emitted light by the OLED is reduced.

Therefore, when the selection of the second scan signal scan2 is deselected in advance as described in the above embodiment, the transistor T4 is turned off in advance, and the voltage charged in the capacitor C is not influenced by the transistor T3. When the transistor T3 is turned off according to deselection of the first scan signal scan1 after the transistor T4 is completely turned off, the current supply through the data line is cut off, and the OLED maintains emitting of the light using the drain current of the transistor T1 which flows corresponding to the voltage maintained by the capacitor C. According to this operation, the transistor T3 is turned off before the transistor T4 is completely turned off to thus prevent reduction of the brightness of the pixel.

Figure 9:
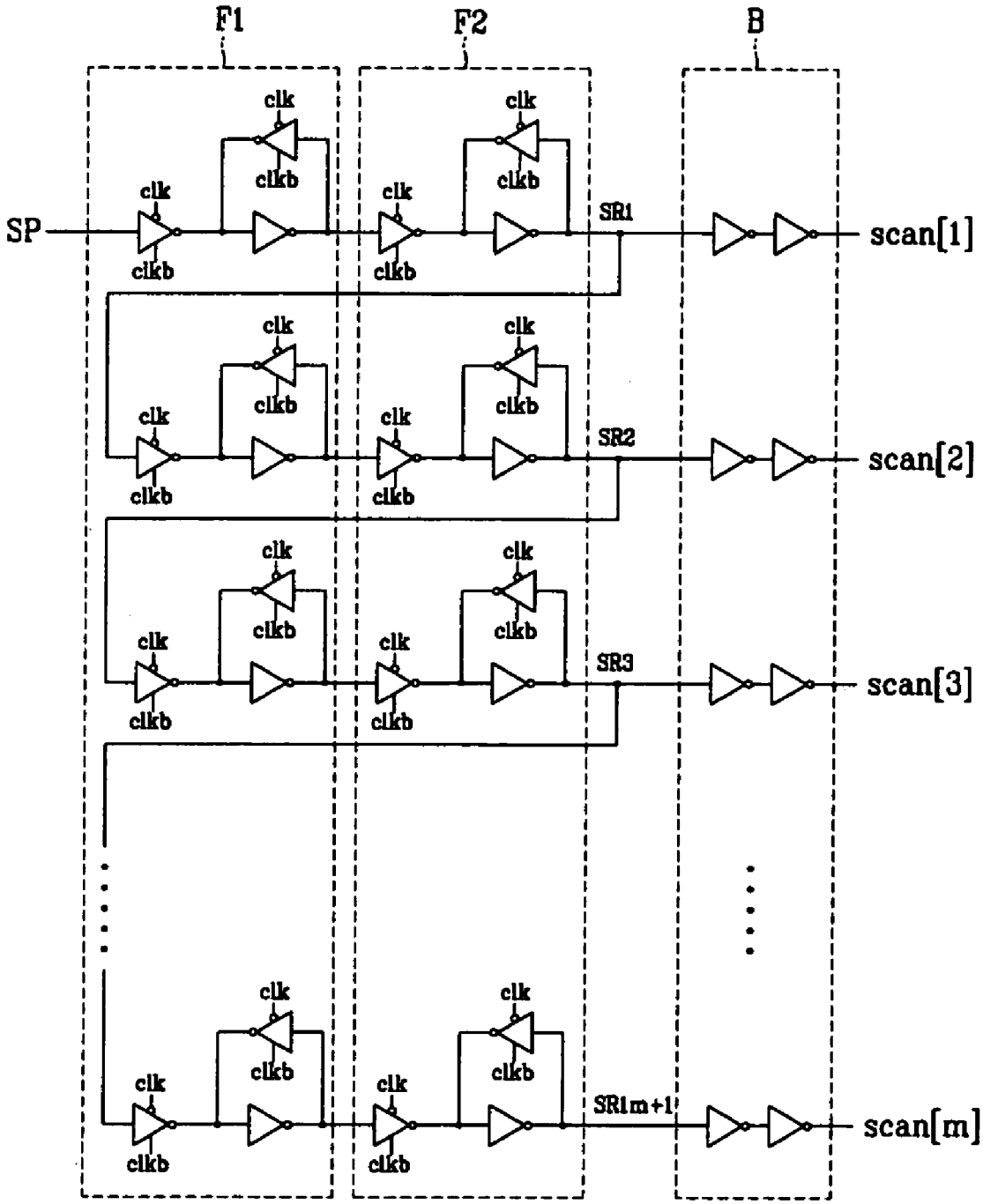
FIG. 9 shows an exemplified configuration of a scan driver of the light emitting display device according to an exemplary embodiment of the present invention.

In order to generate the waveform of FIG. 4, a scan driver having the configuration of FIG. 9 can be used, for example.

FIG. 9 is a scan driver according to an exemplary embodiment of the present invention.

The scan driver shown in FIG. 9 is operated according to the applied signal SP, and includes a plurality of first and second flip-flops F1 and F2, and a plurality of buffers B for outputting the signals output by the second flip-flops F2 to the scan lines scan[1] to scan[m]. No operation of the flip-flops for outputting corresponding signals according to states of input signals will be described, since they are know to a person skilled in the art.

When the above-configured scan driver is a first scan driver for generating the first scan signals scan1, a signal of VSP1, a signal of VCLK1, and a signal of VCLKB1 are respectively input to terminals of the SP, a clk, and a clkb. Also, when the scan driver is a second scan driver for generating the second scan signals scan2, a signal of VSP2, a signal of VCLK2, and a signal of VCLKB2 are respectively input to terminals of the SP, a clk, and a clkb.

Therefore, the time to deselect the second scan signal becomes earlier than the time to deselect the first scan signal when the first and second scan drivers are realized according to the configuration shown in FIG. 9, and the signals of VSP2, VCLK2, and VCLKB2 of the second scan driver for generating the second scan signal and the signals of VSP1, VCLK1, and VCLKB1 of the first scan driver for generating the first scan signals are driven with an offset time as shown in FIG. 4.

The above-used driving method (i.e., the method for allowing the time to deselect the second scan signal for writing display information on the pixel to be earlier than the time to deselect the first scan signal for selecting the pixels) is not only applied to the pixel configuration according to the exemplary embodiment, but can also be applied to other pixel configurations which include transistors arranged in a current mirror configuration.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

According to the present invention, because the time to deselect the second scan signal for writing display information on the pixel is established to be earlier than the time to deselect the first scan signal for selecting the pixels in the pixel structure which includes transistors for forming the current mirror and has two scan lines, a reduction of the amount of the emitted light when the current charged in the pixel before the display operation is finished irrespective of signal delay can be prevented.

Therefore, a light emitting display device with substantially uniform brightness is provided.

What is claimed is:

1. A light emitting display device comprising:

a plurality of data lines, formed in one direction, for transmitting a plurality of data currents;

a plurality of first scan lines, crossing the data lines, for transmitting first scan signals;

a plurality of second scan lines, crossing the data lines, for transmitting second scan signals;

a plurality of pixels, formed at pixel areas located at crossings of the data lines and the first and second scan lines, each said pixel for forming a path of a corresponding said data current transmitted through a corresponding said data line when the pixel is selected by a corresponding said first scan line, and performing a display operation according to the corresponding said data current supplied through the path when the pixel is selected by a corresponding said second scan line;

a first scan driver and a second scan driver for respectively generating the first scan signals for selecting the pixels and the second scan signals for writing display information on the pixels, and respectively applying them to the first and second scan lines; and a data driver for generating the data currents each having a current level according to the display information, and applying the data currents to the data lines, wherein a time to deselect a corresponding said second scan signal is earlier than a time to deselect a corresponding said first scan signal, and wherein an interval between the time to deselect the corresponding said second scan signal and the time to deselect the corresponding said first scan signal is greater than a time duration required for deselection of the corresponding said second scan signal at one of the pixels which is farthest from the second scan driver.

2. The light emitting display device of claim 1, wherein pulse widths of the first and second scan signals are substantially the same as each other.

3. The light emitting display device of claim 1, wherein the interval is greater than 1 μs.

4. The light emitting display device of claim 3, wherein the interval is between 1.5 μs and 4 μs.

5. The light emitting display device of claim 3, wherein the interval is between 1.2 μs and 4 μs.

6. The light emitting display device of claim 1, wherein each said pixel comprises:

a first transistor for forming the path for transmitting the corresponding said data current supplied through the corresponding said data line;

a first switch, operable by the corresponding said first scan signal, for controlling current supply between the corresponding said data line and the first transistor;

a storage capacitor for converting the corresponding said data current flowing through the first transistor into a voltage;

a second switch, operable by the corresponding said second scan signal, for performing a switching operation between the first transistor and the storage capacitor;

a second transistor for forming a current mirror together with the first transistor, and generating a current corresponding to a voltage level of a voltage charged in the storage capacitor; and a light emitting element for emitting light according to a magnitude of the current supplied by the second transistor to perform a display operation.

7. A light emitting display device comprising:

a plurality of data lines, formed in one direction, for transmitting a plurality of data currents;

a plurality of first scan lines, crossing the data lines, for transmitting first scan signals;

a plurality of second scan lines, crossing the data lines, for transmitting second scan signals;

a plurality of pixels, formed at pixel areas located at crossings of the data lines and the first and second scan lines, each said pixel for forming a path of a corresponding said data current transmitted through a corresponding said data line when the pixel is selected by a corresponding said first scan line, and performing a display operation according to the corresponding said data current supplied through the path when the pixel is selected by a corresponding said second scan line;

a first scan driver and a second scan driver for respectively generating the first scan signals for selecting the pixels and the second scan signals for writing display information on the pixels, and respectively applying them to the first and second scan lines; and a data driver for generating the data currents each having a current level according to the display information, and applying the data currents to the data lines, wherein a time to deselect a corresponding said second scan signal is earlier than a time to deselect a corresponding said first scan signal, and wherein each said pixel comprises:

a first transistor for forming the path for transmitting the corresponding said data current supplied through the corresponding said data line;

a first switch, operable by the corresponding said first scan signal, for controlling current supply between the corresponding said data line and the first transistor;

a storage capacitor for converting the corresponding said data current flowing through the first transistor into a voltage;

a second switch, operable by the corresponding said second scan signal, for performing a switching operation between the first transistor and the storage capacitor;

a second transistor for forming a current mirror together with the first transistor, and generating a current corresponding to a voltage level of a voltage charged in the storage capacitor; and a light emitting element for emitting light according to a magnitude of the current supplied by the second transistor to perform a display operation, wherein the first switch couples a drain of the first transistor to the corresponding said data line, and the second switch couples the drain of the first transistor to a gate of the second transistor.

8. The light emitting display device of claim 6, wherein the first switch is turned off according to a level modification of the corresponding said first scan signal when the second switch is turned off according to a level modification of the corresponding said second scan signal.

9. The light emitting display device of claim 6, wherein the light emitting element is an organic light emitting diode.

10. A light emitting display device comprising:

a plurality of data lines, formed in one direction, for transmitting a plurality of data currents;

a plurality of first scan lines, crossing the data lines, for transmitting first scan signals;

a plurality of second scan lines, crossing the data lines, for transmitting second scan signals;

a plurality of pixels, formed at pixel areas located at crossings of the data lines and the first and second scan lines, each said pixel for forming a path of a corresponding said data current transmitted through a corresponding said data line when the pixel is selected by a corresponding said first scan line, and performing a display operation according to the corresponding said data current supplied through the path when the pixel is selected by a corresponding said second scan line;

a first scan driver and a second scan driver for respectively generating the first scan signals for selecting the pixels and the second scan signals for writing display information on the pixels, and respectively applying them to the first and second scan lines; and a data driver for generating the data currents each having a current level according to the display information, and applying the data currents to the data lines, wherein a time to deselect a corresponding said second scan signal is earlier than a time to deselect a corresponding said first scan signal, and wherein the first and second scan drivers include flip-flops which are operable using first and second clock signals and generate the first and second scan signals, and a driving time of the second clock signal is earlier than a driving time of the first clock signal.

11. A method for driving a light emitting display device comprising a plurality of pixel circuits, wherein at least one of the pixel circuits is formed at a pixel area located at a crossing of a data line and first and second scan lines, and comprises a light emitting element, a storage capacitor, a first transistor, and a second transistor forming a current mirror together with the first transistor, the method comprising:

supplying a first scan signal to the first scan line, and forming a path for transmitting a data current supplied through the data line;

supplying a second scan signal to the second scan line, and charging the data current supplied through the data line to the storage capacitor through the first transistor as a voltage; and allowing the light emitting element to emit light in response to a current which is transmitted from a second transistor forming a current mirror together with the first transistor and which corresponds to the voltage charged in the storage capacitor, wherein a time to deselect the second scan signal is earlier than a time to deselect the first scan signal, and wherein an interval between the time to deselect the second scan signal and the time to deselect the first scan signal is greater than a time duration required for deselection of the second scan signal at one of the pixel circuits which is farthest from a scan driver that generates the second scan signal.

12. The method of claim 11, wherein pulse widths of the first and second scan signals are substantially the same as each other.

13. A light emitting display device comprising:

a plurality of data lines for transmitting a plurality of data currents;

a plurality of first scan lines for transmitting a plurality of first scan signals;

a plurality of second scan lines for transmitting a plurality of second scan signals;

a plurality of pixels, each said pixel being coupled to a corresponding said data line, a corresponding said first scan line, and a corresponding said second scan line, wherein each said pixel comprises:

a first switch coupled to the corresponding said first scan line;

a second switch coupled to the corresponding said second scan line;

a light emitting element for emitting light corresponding to a current, which is applied thereto;

a driving transistor for providing the current corresponding to the data current to the light emitting element; and a mirror transistor, which is diode-connected irrespective of selection or deselection of a corresponding said scan signal on the corresponding said second scan line, for forming a current mirror together with the driving transistor, and wherein the corresponding said second scan signal for writing display information to one said pixel, which is transmitted on the corresponding said second scan line, is deselected prior to deselecting a corresponding said first scan signal, which is transmitted on the corresponding said first scan line, for selecting the one said pixel.

14. The image display device of claim 13, further comprising a data driver for providing a corresponding said data current corresponding to the display information to the one said pixel over the corresponding said data line.

15. The image display device of claim 13, wherein the corresponding said first scan signal is used to turn on the first switch to provide the corresponding said data current to a drain of the mirror transistor.

16. The image display device of claim 13, wherein the corresponding said second scan signal is used to turn on the second switch to provide the corresponding said data current to the capacitor to charge the capacitor with a voltage corresponding to the corresponding said data current.

17. The image display device of claim 13, further comprising a first scan driver for providing the first scan signals and a second scan driver for providing the second scan signals.

18. The image display device of claim 13, wherein the corresponding said second scan signal is selected prior to the corresponding said first scan signal, and wherein pulse widths of the first and second scan signals are substantially the same as each other.

* * * * *